US008144032B2

(12) United States Patent
Bogenberger et al.

(10) Patent No.: US 8,144,032 B2
(45) Date of Patent: Mar. 27, 2012

(54) METHOD OF CHECKING THE QUALITY OF TRAFFIC DISTURBANCE REPORTING PROCESSES

(75) Inventors: Klaus Bogenberger, Munich (DE); Robert Hein, Blonhofen (DE); Ronald Kates, Otterfing (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 366 days.

(21) Appl. No.: 12/431,334

(22) Filed: Apr. 28, 2009

(65) Prior Publication Data

US 2010/0073196 A1 Mar. 25, 2010

(30) Foreign Application Priority Data

Apr. 29, 2008 (DE) ..... 10 2008 021 260

(51) Int. Cl.
*G08G 1/065* (2006.01)

(52) U.S. Cl. ..... 340/934; 340/905; 701/118

(58) Field of Classification Search ..... 340/934, 340/905, 928, 936, 937, 995.13; 701/117, 701/118

See application file for complete search history.

(56) References Cited

U.S. PATENT DOCUMENTS 5,822,712 A * 10/1998 Olsson ..... 701/117
5,917,432 A * 6/1999 Rathbone ..... 340/907
6,473,698 B1 * 10/2002 Albert et al. ..... 702/45
6,882,930 B2 * 4/2005 Trayford et al. ..... 701/117
2006/0082472 A1 * 4/2006 Adachi et al. ..... 340/995.13
2009/0002195 A1 * 1/2009 Horvitz et al. ..... 340/934
2010/0117865 A1 * 5/2010 Teffer et al. ..... 340/936

FOREIGN PATENT DOCUMENTS

DE 102 46 185 A1 4/2004
DE 102 46 184 A1 9/2004

* cited by examiner

*Primary Examiner* — Brent Swarthout
(74) *Attorney, Agent, or Firm* — Crowell & Moring LLP

(57) ABSTRACT

A method of checking the quality of traffic disturbance reporting processes records a total number of traffic disturbance reports generated by a traffic disturbance reporting process, which traffic disturbance reports each relate to at least one defined reporting time period and at least one defined reporting route segment, over a predefined analyzing time period and a predefined analyzing range. A number of reported conditions is formed from the total number of traffic disturbance reports, and a first statistical frequency distribution of the reported conditions is determined. A total number of reference observations are recorded, which each relate to at least one defined observation time period and at least one defined observation route segment, within the analyzing time period and within the analyzing range. A number of actual conditions is formed from the total number of reference observations and a second statistical frequency distribution of the actual conditions is determined. The second statistical frequency distribution is compared with the first statistical frequency distribution, and a quality indicator for the traffic disturbance reporting process is derived from the result of the comparison.

13 Claims, 1 Drawing Sheet

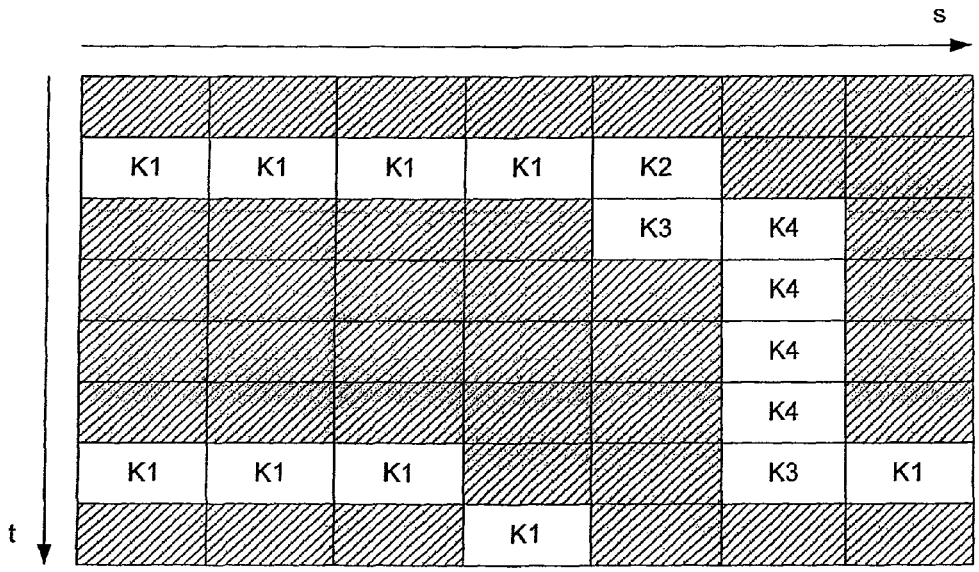

s t

| | | | | | | |
|---|---|---|---|---|---|---|
| K1 | K1 | K1 | K1 | K1 | K1 | K1 |
| K1 | K1 | K1 | K1 | K1 | K1 | K1 |
| K1 | K1 | K1 | K1 | K1 | K1 | K1 |
| K1 | K1 | K2 | K3 | K4 | K4 | K1 |
| K1 | K1 | K2 | K3 | K4 | K4 | K1 |
| K1 | K1 | K1 | K2 | K3 | K4 | K1 |
| K1 | K1 | K1 | K1 | K2 | K3 | K1 |
| K1 | K1 | K1 | K1 | K2 | K3 | K1 |

Fig. 1 s t

| | | | | | | |
|---|---|---|---|---|---|---|
| | | | | | | |
| K1 | K1 | K1 | K1 | K2 | | |
| | | | | K3 | K4 | |
| | | | | | K4 | |
| | | | | | K4 | |
| | | | | | K4 | |
| K1 | K1 | K1 | | | K3 | K1 |
| | | | K1 | | | |

Fig. 2

METHOD OF CHECKING THE QUALITY OF TRAFFIC DISTURBANCE REPORTING PROCESSES

CROSS-REFERENCE TO RELATED APPLICATION

This application claims priority under 35 U.S.C. §119 to German Patent Application No. DE 10 2008 021 260.1, filed Apr. 29, 2008, the entire disclosure of which is herein expressly incorporated by reference.

BACKGROUND AND SUMMARY OF THE INVENTION

The invention relates to a method of checking the quality of traffic disturbance reporting processes.

A method of this type is known, for example, from German patent documents DE 10246184 A1 and DE 10246185 A1. The quality indicators for traffic disturbance reporting processes (QKZ1 and QKZ2), which can be determined according to the teachings of DE 10246184 A1 and/or DE 10246185 A1, permit the evaluation of a probability of the successful report of an occurring traffic disturbance (QKZ1), as well as the evaluation of a probability that an issued report is incorrect (QKZ2).

By means of these two quality indicators, the quality of a traffic disturbance reporting process can be, checked very rapidly and easily. However, the reliability of the quality check can be further improved by alternative or additional measures.

It is an object of the invention to provide a simple method of checking the quality of a traffic disturbance reporting process by which at least one alternative or additional aspect is taken into account.

This object is achieved by a method of checking the quality of traffic disturbance reporting processes, the method including: (a) recording a total number of traffic disturbance reports generated by a traffic disturbance reporting process, which traffic disturbance reports each relate to at least one defined reporting time period and at least one defined reporting route segment, over a predefined analyzing time period and a predefined analyzing range; (b) forming a number of reported conditions from the total number of traffic disturbance reports; (c) determining a first statistical frequency distribution of the reported conditions; (d) recording a total number of reference observations, which each relate to at least one defined observation time period and at least one defined observation route segment, within the analyzing time period and within the analyzing range; (e) forming a number of actual conditions from the total number of reference observations; (f) determining a second statistical frequency distribution of the actual conditions; (g) comprising the second statistical frequency distribution with the first statistical frequency distribution; and (h) deriving a quality indicator for the traffic disturbance reporting process from the result of the comparison. Advantageous embodiments and further developments of the invention are described and claimed herein.

The determined quality indicator can be used as an independent quality indicator for a traffic disturbance reporting process to be checked. However, it can also be evaluated in combination with additional quality indicators, for example, the quality indicators QKZ1 and QKZ2, known from DE 10246184 A1 or DE 10246185 A1. With respect to the determination of quality indicators QKZ1 and QKZ2, reference is made to the teachings of DE 10246184 A1 and DE 10246185 A1, which are herein incorporated by reference as non-essential subject matter.

In particular, the quality indicator determined according to the invention can be used as a measurement for the reliability or informative value of a process quality determined by means of the quality indicators QKZ1 and QKZ2 (or other quality indicators). Thus, it is effectively avoided that favorable values of defined quality indicators, such as QKZ1 and/or QKZ2, are achieved by a traffic disturbance reporting process mainly aimed at favorable values of these quality indicators and/or an analyzing process mainly aimed at favorable values of these quality indicators.

The method according to the invention provides the determination of a quality indicator, which is based on the result of a comparison of two statistical frequency distributions. In this case, the frequency distributions of reported conditions and actual conditions are compared. As with other known quality indicators, such as QKZ1 and QKZ2, determining the quality indicator according to the present invention may be performed using a computer.

The reported conditions are obtained from a total number of traffic disturbance reports which are generated for a given analyzing time period and a given analyzing range by the traffic disturbance reporting process to be checked. It is assumed that these traffic disturbance reports, in each case, relate to at least one defined reporting time period and at least one reporting route segment (for example, "traffic coming to a stop" on Autobahn A9 between junctions X and Y in the time period from 8:30 h to 9:00 h"). The reporting time period must not necessarily be contained in the traffic disturbance report but may, for example, also be the result of its validity period.

The content of a traffic disturbance report typically corresponds to an assignment of the respective at least one reporting time period and reporting route segment to a traffic situation class. For example, the values or definitions of "dense traffic", "traffic coming to a stop", "traffic jam" and "stoppage" may be provided.

The above-mentioned reported conditions are determined from the traffic disturbance reports. In the ideal case, the number of reported conditions should represent the traffic situation on all route segments relevant to the quality check in the analyzing range over the entire analyzing period. To an extent, it represents a report-based traffic model.

Correspondingly, the reported conditions are preferably defined analogous to the same or similar traffic situation classifications as the traffic disturbance reports. A reported condition can, for example, also assume the values or definitions of "dense traffic, "traffic coming to a stop", "traffic jam", and "stoppage". In addition, it may be advantageous to assign a defined route segment to a traffic situation classification "all clear" for a defined time period, particularly in the event that no traffic disturbance report is present for this defined route segment within this defined time period. With respect to the total number of traffic disturbance reports, the number of reported conditions is therefore expanded by a number of undisturbed report conditions, which are not indicated by traffic disturbance reports. This is based on the use of the simple inverse conclusion that, on a route segment for which no traffic disturbance is reported, it is apparently possible to drive under "all clear" conditions. Thus, possibly even every individual route segment in the analyzing range can be assigned for any conceivable time period within the analyzing period to a defined traffic situation classification. Such an expansion or addition can naturally be eliminated when a traffic disturbance report is also always emitted for the "all clear" traffic situation (or similar traffic situations); when therefore the traffic distance reports per se are essentially already complete with respect to the time in the analyzing period and cover the area within the analyzing range. In this case, the values of the traffic disturbance reports may possibly also themselves be directly used as reported conditions.

In the case of the definition of the reported conditions outlined in the preceding paragraphs, a number of reported conditions are obtained, which offer a complete image of the reported traffic situation in the analyzing range within the analyzing period. For reasons of simplicity, it will be assumed in the following that such a complete image is present. The following explanations naturally also apply when the image is intentionally or unintentionally incomplete. For reasons of efficiency, the number of reported conditions may in addition possibly be defined such that it comprises only a representative partial quantity of the total number of traffic disturbance reports or is based on such a partial quantity.

For the thus determined number of reported conditions, a statistical frequency distribution is determined. Here, in the simplest case, the mere frequency of the occurrence of a defined reported condition (such as "traffic jam") can be taken into account. However, the length of the respective reporting route segment can also be taken into account in a weighted manner. For example, a traffic jam segment of a length of 3 km will then increase the frequency of the "traffic jam" definition three times as much as a traffic jam segment of a length of 1 km. In the case of reporting time periods of unequal lengths, the length of the reporting time periods can correspondingly be taken into account in a weighted manner.

The invention is based on the technical consideration that the statistical frequency distribution of the reported conditions in the above-mentioned complete image of the reported traffic situation—in the case of a corresponding quality of the traffic disturbance reporting process—should basically correspond to the statistical frequency distribution of the actual traffic conditions in the real traffic situation in the analyzing range within the analyzing time period. Finally, it is a requirement that a traffic disturbance reporting process represents the real traffic situation as precisely as possible.

For comparison purposes, a frequency distribution of actual conditions is therefore determined as a reference.

For this purpose, reference observations are first made, which in each case refer to at least one defined observation period within the analyzing period and at least one defined observation route segment within the analyzing range. Preferably, the observation periods and the reporting time periods are defined analogous to one another in order to permit a simple assignment. A corresponding situation applies to observation route segments and reporting route segments.

According to a preferred embodiment of the present invention, dedicated measuring drives are carried out for recording the reference observations. Measuring vehicles are therefore used as mobile traffic flow sensors which make reference observations. It is assumed that the reference observations are in each case related to at least one defined observation period within the analyzing period and at least one defined observation route segment within the analyzing range. As a rule, this is the observation route segment traveled in the observation period.

The recording of the reference observations may take place in an automated manner by the measuring vehicles or with the cooperation of the vehicle occupants. In particular, in the case of a cooperation of the vehicle occupants, measurements or observations that are not very informative or particularly useful can be manually suppressed in order not to falsify the process. For example, in this manner, a drive that is slow—even without any traffic obstruction—as a result of driving through a slow curve at a highway intersection, can be faded out. As required, the reference observations may even take place independently by the vehicle occupants. The measuring vehicles can then be conventional motor vehicles.

In principle, the determination of the reference observations, as an alternative or in addition, can also take place completely or partially on the basis of conventional floating car data (FCD), which are not obtained within the scope of dedicated measuring drives. Likewise, the determination of the reference observations can, in principle, also take place completely or partially on the basis of stationary traffic flow sensors. In each case, care should be taken that the reference observations represent the real traffic situation so well that they are usable as informative "ground truth" for the subsequent comparison. This demand can best be met within the scope of dedicated measuring drives whose point in time, duration, route, distance, area coverage, etc. can be planned correspondingly. In addition, dedicated measuring drives may also relate to unexploited analyzing ranges which are not equipped with stationary traffic flow sensors and/or in which no, or too few, FCD participants are available.

The reference observations are preferably defined analogous to the above-mentioned traffic disturbance reports. The content of a reference observation then corresponds to an assignment of the respective at least one observation period and observation route segment to a traffic situation classification. For example, the values or definitions "dense traffic", "traffic coming to a stop", "traffic jam" and "stoppage" may be again provided.

A number of actual conditions are derived from the total number of reference observations. In this simplest case, this takes place precisely as the above-described derivation of the reported conditions from the traffic disturbance reports. Thus, on the one hand, reference observations can be converted directly to actual conditions; on the other hand, actual conditions (such as "all clear") can be logically amended for observation periods and observation route segments which were observed but for which no disturbance was determined. In this case, a route segment observed in a defined time period is a route segment where a measuring vehicle had been in the respective time period. By means of such an amendment, in the ideal case, each individual route segment observed within the scope of the measuring drives in the analyzing range for the respective observation period can be assigned to a defined traffic situation classification. Of course, if the "all clear" definition is already provided in the reference observations, such an amendment or expansion will not be necessary.

In the case of the outlined definition of the actual conditions, a number of actual conditions are obtained which offers an observed cutout of the real traffic situation in the analyzing range within the analyzing period. For reasons of simplicity, it will be assumed in the following that such a cutout includes actual conditions for all observation route segments in the respective observation periods traveled within the scope of the measuring drives. The following explanations will naturally apply equally when the cutout is intentionally or unintentionally incomplete. For reasons of efficiency, the number of actual conditions may, in addition, also possibly include a representative partial quantity of the total number of reference observations.

For the thus determined number of actual conditions, a statistical frequency distribution is determined. Here, in the simplest case, the mere frequency of a defined actual condition (for example, "traffic jam") can be taken into account. However, the length of the respective observation route segment may also be considered in a weighted manner. In the case of unequally long observation periods, the length of the observation periods can be taken into account in a weighted manner.

In the next step of the quality checking process, the statistical frequency distribution of the reported conditions is compared with the statistical frequency distribution of the actual conditions.

The frequency values of the individual reported conditions and/or actual conditions are preferably standardized to a common dimension before or during the comparison. For example, the frequency of each individual definition can be determined as a percentage of the respective total number of available condition values.

The comparison of the two frequency distributions preferably takes place by means of the chi-square distribution test.

In this case, particularly the hypothesis can be tested that the frequency distribution of the reported conditions corresponds to the frequency distribution of the actual conditions.

The result of the comparison can be considered and used as a quantitative or binary quality indicator for the traffic disturbance reporting process on which the reported conditions are based.

When the chi-square test is used, the rejection or acceptance of the hypothesis is preferably used as a binary quality indicator. Depending on the requirements, as an alternative or in addition, the value of $\chi^2$ (chi-squared) can be used as a quantitative quality indicator. In the latter case, the low values of $\chi^2$ (chi-squared) represent a high process quality.

By means of the method according to the invention, it becomes possible to disclose fundamental process errors when generating traffic disturbance reports. When it is, for example, recognized that the statistical frequency distribution of the reported conditions based on the traffic disturbance reports deviates from the frequency distribution of the actual conditions such that the fraction of the disturbance condition values, i.e., of all condition values that do not have the "all clear" value, is significantly lower in the case of the reported conditions than in the case of the actual conditions, a conclusion can be drawn that the detection was basically insufficient, for example, because of an insufficient area coverage. When, in contrast, it is recognized according to another example that the statistical frequency distribution of the reported conditions based on the traffic disturbance reports deviates from the frequency distribution of the actual conditions such that the fraction of large disturbance condition values, for example, "traffic jam" and "stoppage", is higher in the case of the reported conditions than in the case of the actual conditions, but the fraction of moderate disturbance condition values, for example, "dense traffic" and "traffic coming to a stop", is lower in the case of the reported conditions than in the case of the actual conditions, a conclusion can be drawn that the analysis of the extent of a disturbance as the cause of the deviation is exaggerated.

When the quality is checked, the majority of the reporting or observation route segments (or all reporting or observation route segments) are preferably defined as a route segment between two consecutive junctions (entry and/or exit) of an expressway (for example, a highway or turnpike). As a rule, a further space-related granulation does not achieve any goal because it is unimportant for the driver where exactly a loss of time caused by the traffic disturbance occurs within the route segment.

The used traffic situation classifications are preferably defined following certain speed ranges. For example, the definition "stoppage" may be assigned to a traffic situation with average speed values in the speed range from 0 to 10 km/h. The definition "traffic jam" may be assigned to speed values in the speed range of from 0 to 50 km/h; the definition "all clear", etc. may be assigned to speed values over 110 km/h. The speed ranges may also overlap. This means that a hysteresis taking place in the overlapping range is not treated negatively in the reporting time sequence of the checked traffic disturbance reporting process in the analysis.

Correspondingly, the average speed of a measuring vehicle on the observation route segment is preferably used as a basis for the determination of a value of the reference observation for a defined observation route segment and a defined observation time period.

According to a preferred embodiment of the present invention, the analyzing time period is defined as a part of the day, for example, of a duration of several hours. Since the traffic situation, as a rule, is comparable in the same part of the day on different days, particularly the same type of days (for example, a workday), particularly the same weekdays (such as Monday), the above-mentioned quality check may relate to traffic disturbance reports and reported conditions derived therefrom and/or reference observations and actual conditions derived therefrom which are obtained on several days.

The analyzing period may be composed of several parts of the day; for example, a morning rush time from 6 a.m. to 9 a.m. and an evening rush time from 4 p.m. to 7 p.m. together may form the "rush time" analyzing period.

According to a particularly advantageous embodiment of the present invention, the method of checking the quality is carried out separately for different analyzing time periods of a higher-ranking main time period. The analyzing time periods within the main time period may be defined to be overlapping or disjoint. The main time period preferably is also a part of the day, as required, even a part of the day lasting 24 hours. For example, the main time period may comprise 16 hours and last from 4 o'clock in the morning until 10 o'clock in the evening. Within this time period, for example, separate quality checks can be carried out for the following analyzing time periods:

Rush hours (for example, 6 a.m. to 9 a.m. and 4 p.m. to 7 p.m.)

Idle time in the morning (for example, 4 a.m. to 6 a.m.)

Idle time in the evening (for example, 7 p.m. to 10 p.m.)

Midday hours (for example, 9 a.m. to 4 p.m).

This division of the total quality check into separate quality checks for the different analyzing time periods (also called time segments of the main time period) is based on the consideration that the statistical frequency distribution of the real traffic conditions empirically is quantitatively as well as qualitatively very different for different time segments of the day. As a result of this division, these effects and their influence on the quality of the traffic disturbance reporting processes to be checked can be taken into account in an improved manner. A combining of the different frequency distributions of the individual time segments to a single common frequency distribution—relative to the total main time period—would in comparison reduce the informative value of the quality check.

The separate quality check for each time segment increases the respective informative value. Thus, depending on the requirements, it may be found out that or whether the quality of the checked traffic disturbance reporting process depends on the time of day and/or on whether the checked traffic disturbance reporting process is suitable in different fashions for representing the traffic situation in different time segments.

Likewise, as a result of the division into time segments, it can be recognized whether the traffic situation in certain time segments makes an analysis by means of the quality checking method according to the invention and/or by means of another quality checking method impossible or at least more difficult and/or impairs the informative value of the results. For example, a rate of the actual condition "all clear" that reaches almost 100% and a correspondingly low frequency of other actual conditions, as it occurs particularly in idle times in certain analyzing ranges, makes an informative quality check very difficult or impossible.

When the chi-square test is applied, a criterion can be defined which the quality checking method has to meet in order to have informative value. For the sampling quantity N of an informative chi-square test, various minimal quantities are known from literature, which are oriented according to the lowest frequency value represented in a frequency distribution. In the following, for example, the criterion N=5/p_min is used as a known minimum quantity N of this type.

In this case, p_min is the lowest represented probability value(=frequency in percent) of a traffic situation classification in the frequency distribution of the actual conditions.

When p_min is, for example, equal to 2 percent, the dimensionless number 250 is obtained as the sampling quantity N.

When a number of actual conditions is already present, it can be checked as to whether an informative chi-square test can be carried out.

According to an inventive further development of the present invention, a recommended quantity for planning further measuring drives can be derived from the dimensionless sampling quantity N.

The sampling quantity represents the number of actual conditions collected during the measuring drives, which actual conditions in each case relate to an observation route segment and an observation time period.

For reasons of simplicity, it is assumed in the following that the observation route segments—as outlined above—are each defined as the route segment of an expressway between two consecutive junctions. During each drive between two junctions, an actual condition value for the corresponding observation route segment is then collected, which relates to the concerned observation time period which again in the simplest case is defined as being equal to the time period of the stay on the observation route segment. In the case of such a definition, precisely one actual condition value is obtained between two junctions. Also in the case of another definition of the observation time period—for example, such that the duration of a typical observation time period is clearly longer than the typical time of the stay on an observation route segment—, in a normal case, the recording of one actual condition value per traveled observation route segment can be assumed. When the observation time periods are defined to be shorter, the recording of one actual condition value per traveled observation route segment can be considered a "worst case".

In order to reach a certain sampling quantity N, a corresponding number of observation route segments have to be traveled; i.e., an equally large number N_AS of junctions have two be traversed during the measuring drives. This still dimensionless number N_AS can be converted to a concrete planning quantity for future measuring drives to be planned in that the average distance D between two junctions is taken into account. The product of the above-mentioned number N_AS of junctions to be traversed with the distance D results in the required mileage (length) for the measuring drives in the analyzing range within the analyzing time period which are at least required for the implementation of an informative chi-square test. Thus, as a recommended quantity for the planning of further measuring drives, a required length of the measuring drives is derived from an applicability criterion of the method that is used for comparing the two frequency distributions.

For tests other than the chi-square test, similar criteria can be derived in a corresponding manner.

By means of the above-described further development of the invention, the planning of measuring drives is considerably improved. Test kilometers or miles from measuring drives, which are frequently absent when known planning methods are used, can be traveled in time. Superfluous measuring drives are not necessary whereby immense cost savings can be achieved. In addition, fuel consumption and harm to traffic and environment are lowered.

When, during the above-described calculation, an impractically high number of required test kilometers/miles is determined, in the corresponding analyzing range, test drives in the corresponding analyzing period (for example, in one of several time segments) do not have to take place at all because no informative result will be obtainable at expenditures that can be clearly envisioned.

As an alternative or in addition, further criteria can also be used, which have to be met so that test drives are carried out at all in a defined analyzing range in a defined analyzing period. These criteria may relate, for example, directly to reaching a minimum probability for each individual traffic situation classification or to a total probability of the occurrence of disturbed traffic situations (all conditions except "all clear").

For the further improvement of the planning of measuring drives, the area covered in an analyzing range can be controlled by a graphic display of traversed junctions (covered location codes) and not traversed junctions (non-covered location codes).

Other objects, advantages and novel features of the present invention will become apparent from the following detailed description of one or more preferred embodiments when considered in conjunction with the accompanying drawings.

BRIEF DESCRIPTION OF THE DRAWINGS

FIG. 1 is a diagram providing an example of the number of reported conditions in the case of a method according to the invention; and FIG. 2 is a diagram of an example of the number of actual conditions in the case of a method according to the invention.

DETAILED DESCRIPTION OF THE DRAWINGS

For a region in and around City A (analyzing range), a service provider SP emits or issues traffic disturbance reports. In this case, the entire expressway network in the analyzing range is to be covered.

By means of a quality checking method, a quality indicator is to be determined, which supplies information with respect to the question as to whether the traffic disturbance reports adequately reflect the real traffic situation in the morning rush hours (6 a.m. to 8 a.m.=analyzing time period).

A report-based traffic model (VM_M) of the analyzing range in the analyzing time period is first derived from the traffic disturbance reports. For this purpose, the analyzing time period is divided into time segments (reporting time periods) of a duration of 15 minutes respectively. The expressways in the analyzing range are divided into segments (reporting route segments), which are each defined as a route segment of an expressway between two consecutive junctions. At a number M1 of reporting route segments and a number M2 of reporting time periods, M1*M2 tuples to be considered are obtained consisting of one reporting route segment and one reporting time period, respectively.

FIG. 1 illustrates an example of the structure of the report-based traffic model VM_M for M2=8 and M1=7 (in practice, the value particularly of M1 is naturally much larger). The reporting route segments are entered in rows toward the right along the axis s; the reporting time periods are indicated in the columns in the downward direction along the axis t. The result is 56 tuples illustrated as blocks in FIG. 1.

The traffic disturbance reports emitted by the service provider include reports concerning disturbances whose definitions are made following certain speed ranges. Definition K4 is assigned to a traffic situation with average speed values in the speed range from 0 to 10 km/h. Definition K3 is assigned to speed values in the speed range of from 10 km/h to 50 km/h; definition K2 is assigned to speed values in the speed range of from 50 km/h to 110 km/h; and definition K1 is assigned to speed values above 110 km/h.

As a rule, the traffic disturbance reports themselves are based on a traffic model (VM_SP) maintained by the service provider. However, in principle, their origin can be left open because the traffic disturbance reports per se are not considered to be "true". It is specifically their reliability and informative values that is to be checked by the quality checking method.

It is assumed that, for each of the above-mentioned M1*M2 tuples, a traffic situation classification K1, K2, K3 or K4 is determined at the service provider by way of the VM_SP. However, traffic disturbance reports are issued only for traffic situation classifications K2, K3 and K4. For all other tuples, it can therefore be assumed that they are part of traffic situation classification K1.

Correspondingly, in traffic model VM_M, the corresponding reported condition K2, K3 or K4 is assigned to each tuple affected by the traffic disturbance report. Any tuples not affected by a traffic disturbance report receive the reported condition K1. FIG. 1 illustrates a reported condition as an example for each tuple.

The report-based traffic model VM_M therefore provides a complete image of the reported traffic situation in the analyzing range within the analyzing time period.

As a basis for a comparison, reference observations are made by means of measuring drives, and actual conditions of the expressways in the analyzing range within the analyzing time period are derived therefrom.

The actual conditions form an observation-based traffic model VM_B.

The definition of the observation route segments used here is identical with the definition of the reporting route segments. The definition of the observation time periods is identical with the definition of the reporting time periods. FIG. 2 illustrates an example of the structure of the observation-based traffic model VM_B.

In the case of the measuring drives, a traffic situation classification is determined for each observation route segment by means of the average speed of the measuring vehicle on the observation route segment. The traffic situation classifications used in this case are the same as the ones indicated above in connection with the output of the traffic disturbance reports: definition K4 is assigned to a traffic situation with average speed values in the speed range of from 0 to 10 km/h; definition K3 is assigned to speed values in the speed range of from 10 km/h to 50 km/h; definition K2 is assigned to speed values in the speed range of from 50 km/h to 110 km/h; and definition K1 is assigned to speed values above 110 km/h.

Thus, the corresponding value is assigned as a reference observation to each observation route segment for each observation time period in which a measuring vehicle has been at least temporarily in this observation route segment and in which the average speed on the observation route segment was lower than 110 km/h; thus, one of the classifications K2, K3 or K4 was determined.

The reference observations are completely taken over as actual conditions for the corresponding tuples consisting in each case of one observation route segment and one observation time period. In addition, the actual condition K1 is noted for each observation route segment for each observation time period in which a measuring vehicle had been at least temporarily in this observation route segment and for which no actual condition of the K2, K3 or K4 definition is recorded. In FIG. 2, an actual condition is entered for each observed tuple as an example. The two "tracks" in FIG. 2 originate from two different measuring vehicles. Not observed tuples (i.e., combinations of one observation route segment and one observation time period respectively, to which it applies that no measuring vehicle has been on the observation route segment in the respective observation time period) receive no actual condition (hatched in FIG. 1).

As a consequence of the above-described manner of forming the observation-based traffic model VM_B, pairs of tuples or actual conditions may occur which originate from the measuring vehicle itself, concern the same observation time period but different (adjacent) observation route segments (for example, the second row in FIG. 2). To the extent that this effect is undesirable, it can be avoided by an alternative definition of the observation time periods, for example, by use of the points-in-time at which the junctions are traversed. Assuming slow changes of the traffic situation and observation time periods dimensioned to be brief in this respect, however, no falsifications of the process results occur from the above-mentioned effect.

The number of actual conditions of the observation-based traffic model VM_B represents an observed cutout of the real traffic situation in the analyzing range within the analyzing time period.

The frequency distribution of the reported conditions is now compared with the frequency distribution of the actual conditions in order to determine a quality indicator for the traffic disturbance reporting process on which the traffic disturbance reports are based.

For the reported conditions, the following frequency distribution is obtained:

K1=73.2% (represented 41 times in 56 values)
K2=8.9% (represented 5 times in 56 values)
K3=8.9% (represented 5 times in 56 values)
K4=8.9% (represented 5 times in 56 values)

For the actual conditions, the following frequency distribution is obtained:

K1=56.3% (represented 9 times in 16 values)
K2=6.3% (represented once in 16 values)
K3=12.5% (represented twice in 16 values)
K4=25.0% (represented 4 times in 16 values)

It is assumed that the quality indicator is defined to be binary in the present case. It consists of the acceptance or rejection of a hypothesis while a significance level is given. The hypotheses consists of the fact that the frequency distribution of the traffic flow classifications K1, K2, K3, K4 in the number of reported conditions in VM_M is subject to a certain distribution, specifically the frequency distribution of the traffic flow classifications K1, K2, K3, K4 in the number of actual conditions in VM_B.

The checking of the hypothesis takes place in a manner known per se by means of the chi-square test.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A quality checking method for traffic disturbance reporting processes, the method comprising the acts of:

receiving, by a computer from a service provider, a total number of traffic disturbance reports generated by a traffic disturbance reporting process, which traffic disturbance reports each relate to at least one defined reporting time period and at least one defined reporting route segment, over a predefined analyzing time period and a predefined analyzing range;

forming, by the computer, a number of reported conditions from the total number of traffic disturbance reports;

generating, by the computer, a first statistical frequency distribution of the reported conditions;

recording, by the computer, a total number of reference observations made by at least one measuring vehicle which each relate to at least one defined observation time period and at least one defined observation route segment, within the analyzing time period and within the analyzing range;

forming, by the computer, a number of actual conditions from the total number of reference observations made by the at least one measuring vehicle;

generating, by the computer, a second statistical frequency distribution of the actual conditions;

comparing, by the computer, the second statistical frequency distribution with the first statistical frequency distribution; and generating, by the computer, a quality indicator for the traffic disturbance reporting process from a result of the comparison.

2. The method according to claim 1, wherein the act of comparing, by the computer, the second statistical frequency distribution with the first statistical frequency distribution is carried out by using a chi-square distribution test.

3. The method according to claim 1, wherein the reference observations are recorded by measuring drives.

4. The method according to claim 2, wherein the reference observations are recorded by measuring drives.

5. The method according to claim 3, wherein as a recommended quantity for planning additional measuring drives, a required length of the measuring drives is derived from an applicability criterion of the process used for comparing the two frequency distributions.

6. The method according to claim 4, wherein as a recommended quantity for planning additional measuring drives, a required length of the measuring drives is derived from an applicability criterion of the process used for comparing the two frequency distributions.

7. The method according to claim 1, wherein the number of reported conditions is expanded with respect to the total number of traffic disturbance reports by a number of undisturbed reported conditions not indicated by traffic disturbance reports.

8. The method according to claim 2, wherein the number of reported conditions is expanded with respect to the total number of traffic disturbance reports by a number of undisturbed reported conditions not indicated by traffic disturbance reports.

9. The method according to claim 3, wherein the number of reported conditions is expanded with respect to the total number of traffic disturbance reports by a number of undisturbed reported conditions not indicated by traffic disturbance reports.

10. The method according to claim 4, wherein the number of reported conditions is expanded with respect to the total number of traffic disturbance reports by a number of undisturbed reported conditions not indicated by traffic disturbance reports.

11. The method according to claim 6, wherein the number of reported conditions is expanded with respect to the total number of traffic disturbance reports by a number of undisturbed reported conditions not indicated by traffic disturbance reports.

12. The method according to claim 1, wherein the method further comprises the act of outputting, by the computer, the quality indicator in the form of a numeric value that corresponds to a likelihood of whether the traffic disturbance reports adequately reflect actual traffic conditions.

13. A quality checking method for traffic disturbance reporting processes, the method comprising the acts of:

receiving by a computer, from a service provider, a total number of traffic disturbance reports generated by a traffic disturbance reporting process, which traffic disturbance reports each relate to at least one defined reporting time period and at least one defined reporting route segment, over a predefined analyzing time period and a predefined analyzing range;

forming by a computer a number of reported conditions from the total number of traffic disturbance reports;

generating by a computer a first statistical frequency distribution of the reported conditions;

recording by a computer a total number of reference observations made by at least one measuring vehicle which each relate to at least one defined observation time period and at least one defined observation route segment, within the analyzing time period and within the analyzing range;

forming by a computer a number of actual conditions from the total number of reference observations by the at least one measuring vehicle;

generating by a computer a second statistical frequency distribution of the actual conditions;

comparing by a computer the second statistical frequency distribution with the first statistical frequency distribution;

generating by a computer a quality indicator for the traffic disturbance reporting process from a result of the comparison; and outputting by a computer the quality indicator in the form of a numeric value that corresponds to a likelihood of whether the traffic disturbance reports adequately reflect actual traffic conditions.

* * * * *